US007806724B2

(12) United States Patent
Paynter et al.

(10) Patent No.: US 7,806,724 B2
(45) Date of Patent: Oct. 5, 2010

(54) COAXIAL CONNECTOR FOR CABLE WITH A SOLID OUTER CONDUCTOR

(75) Inventors: Jeffrey Paynter, Momence, IL (US); Al Cox, Orland Park, IL (US)

(73) Assignee: Andrew LLC, Hickory, NC (US)

( * ) Notice: Subject to any disclaimer, the term of this patent is extended or adjusted under 35 U.S.C. 154(b) by 113 days.

(21) Appl. No.: 12/264,932

(22) Filed: Nov. 5, 2008

(65) Prior Publication Data

US 2010/0112853 A1 May 6, 2010

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS

| | | | | |
|---|---|---|---|---|
| 3,671,926 | A | 6/1972 | Nepovim | |
| 3,744,011 | A | 7/1973 | Blanchenot | |
| 3,757,279 | A | 9/1973 | Winston | |
| 3,761,870 | A | 9/1973 | Drezin et al. | |
| 4,824,400 | A * | 4/1989 | Spinner | 439/578 |
| 4,923,412 | A | 5/1990 | Morris | |
| 5,267,877 | A | 12/1993 | Scannelli et al. | |
| 5,352,134 | A | 10/1994 | Jacobsen et al. | |
| 5,944,556 | A | 8/1999 | Wlos et al. | |
| 5,967,852 | A | 10/1999 | Follingstad et al. | |
| 6,019,636 | A | 2/2000 | Langham | |
| 6,808,415 | B1 | 10/2004 | Montena | |
| 6,848,939 | B2 | 2/2005 | Stirling | |
| 7,011,546 | B2 | 3/2006 | Vaccaro | |
| 7,156,696 | B1 | 1/2007 | Montena | |
| 7,249,969 | B2 | 7/2007 | Paynter | |
| 7,329,149 | B2 | 2/2008 | Montena | |
| 7,335,059 | B2 | 2/2008 | Vaccaro | |
| 7,588,460 | B2 * | 9/2009 | Malloy et al. | 439/578 |
| 2005/0164552 | A1 | 7/2005 | Wlos et al. | |
| 2009/0325420 | A1 * | 12/2009 | Paynter | 439/578 |

OTHER PUBLICATIONS

International search report for counterpart application No. PCT/US2009/063315. Issued on Jun. 22, 1010.
International search report for counterpart application No. PCT/US2009/063320. Issued on Jun. 22, 1010.

* cited by examiner

*Primary Examiner*—James Harvey
*Assistant Examiner*—Vanessa Girardi
(74) *Attorney, Agent, or Firm*—Babcock IP, PLLC

(57) ABSTRACT

A coaxial connector with a connector body is provided with a connector body bore. A grip ring is retained within the connector body bore, and an outer diameter of the grip ring abuts an annular wedge surface provided with a taper between a maximum diameter proximate the connector end and a minimum diameter proximate the cable end. The wedge surface may be provided directly on the connector body bore sidewall or alternatively on an inner diameter of a clamp ring coupled to the cable end of the connector body. An inner diameter of the grip ring is provided with a grip surface. A spring contact is retained within the connector body bore. The grip surface and an inner diameter of the spring contact are dimensioned to receive the outer conductor from the cable end there through and to then couple with an outer diameter of the outer conductor.

21 Claims, 10 Drawing Sheets

COAXIAL CONNECTOR FOR CABLE WITH A SOLID OUTER CONDUCTOR

BACKGROUND

1. Field of the Invention

This invention relates to electrical cable connectors. More particularly, the invention relates to a solid outer conductor coaxial cable connector coupled to a coaxial cable by insertion of the cable end into a connector body bore.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 5,795,188 issued Aug. 18, 1998 to Harwath.

Machine threaded coupling surfaces between the metal body and the coupling nut of U.S. Pat. No. 5,795,188 and similarly configured prior coaxial connectors significantly increase manufacturing costs and installation time requirements. Another drawback is the requirement for connector disassembly, sliding the back body over the cable end and then performing a precision cable end flaring operation, which retains the cable within the connector body during threading. Further, care must be taken at the final threading procedure and/or additional connector element(s) added to avoid damaging the flared end portion of the outer conductor as it is clamped between the body and the coupling nut to form a secure electrical connection between the outer conductor and the coaxial cable.

Alternative coaxial connector solutions, utilizing gripping/and or support elements about which the connector body is then radially crimped and/or axially compressed to secure an electromechanical interconnection between the outer conductor of the coaxial cable and the connector, are also known in the art. Crimped and/or compressed connections may be subject to varying quality depending upon the specific force level applied by the installer in each instance. Support surfaces added to prevent collapse of the outer conductor inserted within the inner diameter of the outer conductor, common in connectors for non-solid outer conductor coaxial cables, introduce an electrical performance degrading impedance discontinuity into the signal path. Further, crimping and/or compression becomes impractical with larger diameter coaxial cables, as the increased diameter, sidewall thickness and/or required travel of the corresponding connector/back body(s) increases the required force(s) beyond the levels deliverable by conventional crimp/compression hand tools.

Competition in the coaxial cable connector market has focused attention on improving electrical performance and minimization of overall costs, including materials costs, training requirements for installation personnel, reduction of dedicated installation tooling and the total number of required installation steps and or operations.

Therefore, it is an object of the invention to provide a coupling nut that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has analyzed available solid outer conductor coaxial connectors and recognized the drawbacks of threaded inter-body connection(s), manual flaring installation procedures and crimp/compression coaxial connector designs.

Figure 1:
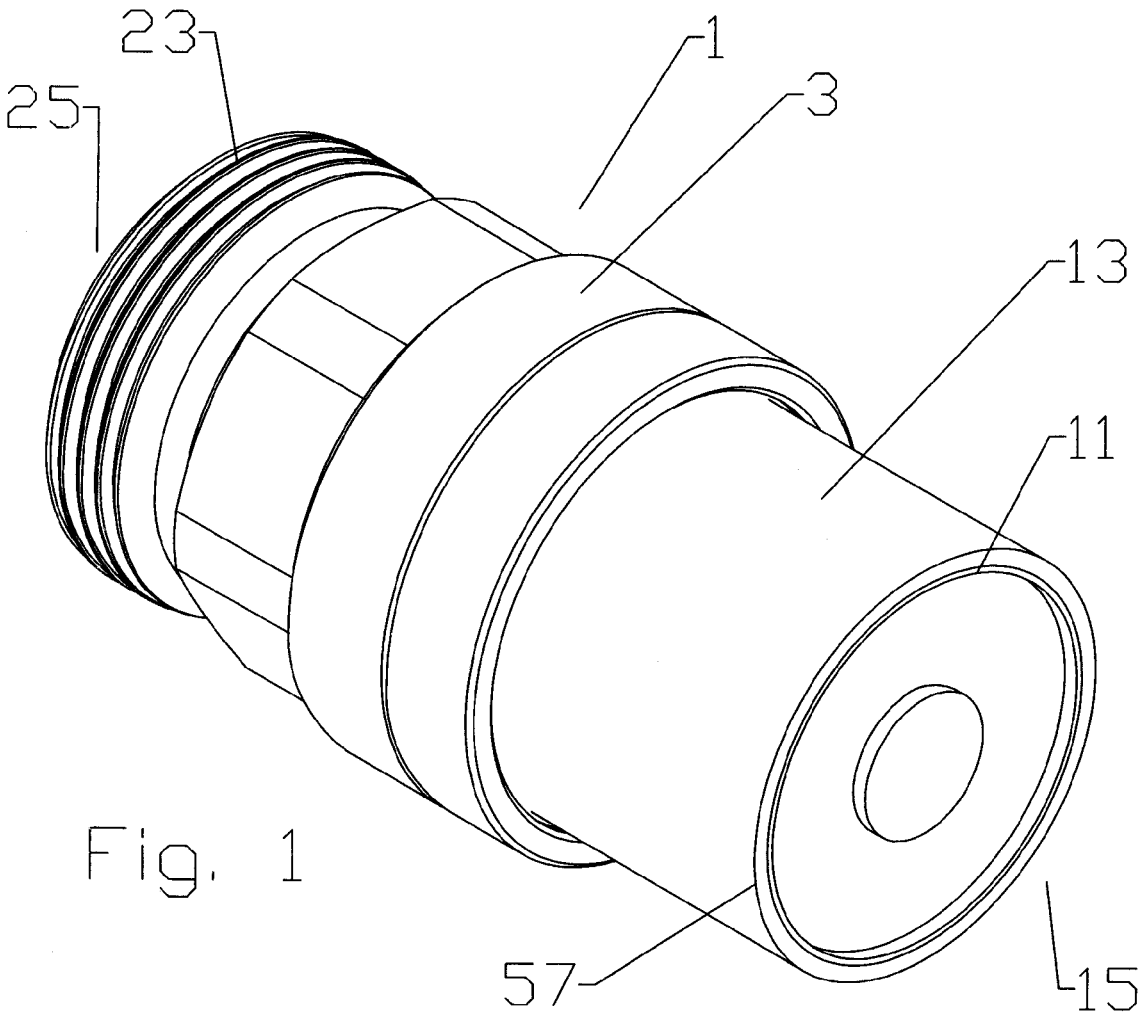
FIG. 1 is a schematic isometric rear view of a first exemplary embodiment of a coaxial connector.
Figure 2:
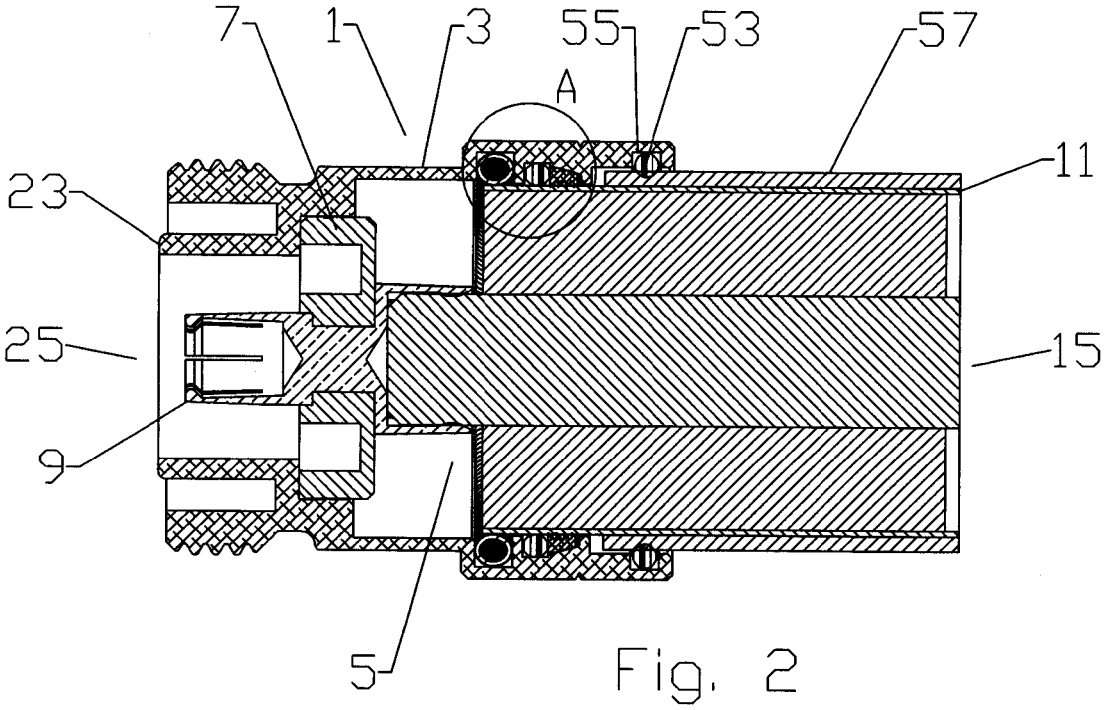
FIG. 2 is a schematic cross-section side view of the coaxial connector of FIG. 1, with a section of coaxial cable attached.
Figure 3:
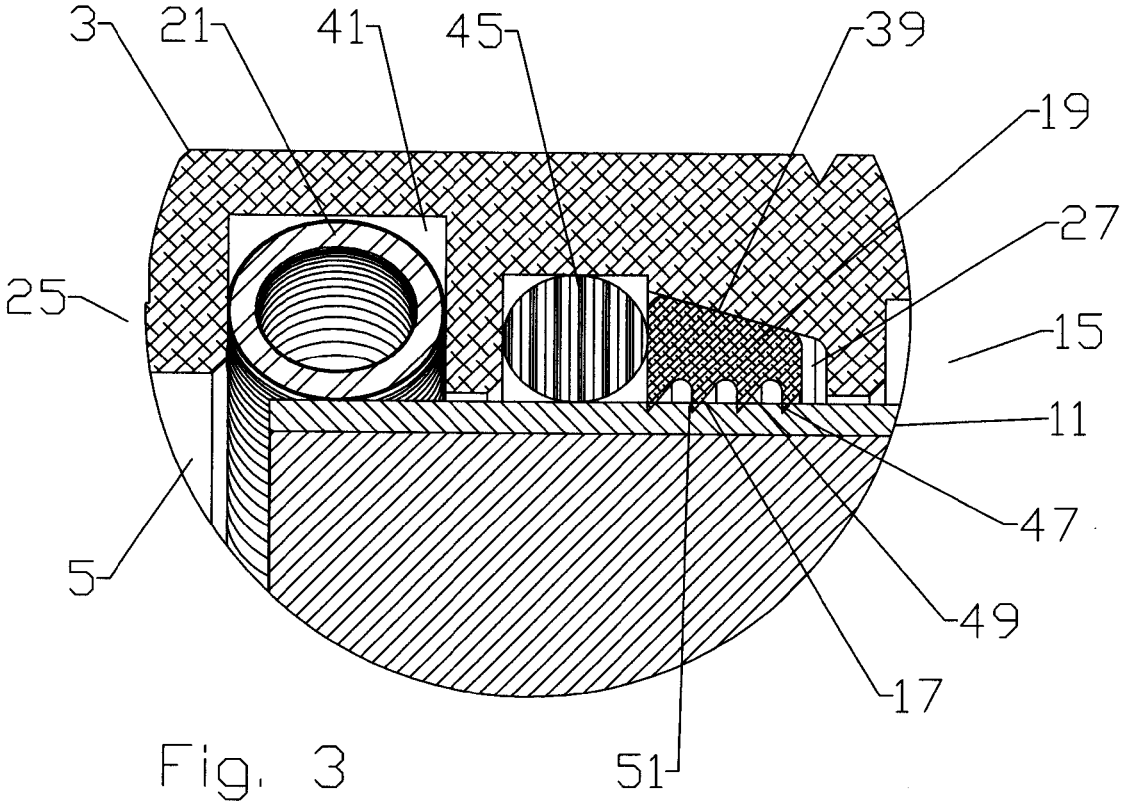
FIG. 3 is a close-up view of area A of FIG. 2.

As shown in a first exemplary embodiment in FIGS. 1-3, a coaxial connector 1 according to the invention has a connector body 3 with a connector body bore 5. An insulator 7 seated within the connector body bore 5 supports an inner contact 9 coaxial with the connector body bore 5. The coaxial connector 1 mechanically retains the outer conductor 11 of a coaxial cable 13 inserted into the cable end 15 of the connector body bore 5 via a grip surface 17 located on the inner diameter of a grip ring 19. A spring contact 21 seated within the connector body bore 5 makes circumferential contact with the outer conductor 11, electrically coupling the outer conductor 11 across the connector body 3 to a connector interface 23 at the connector end 25.

The connector interface 23 may be any desired standard or proprietary interface.

One skilled in the art will appreciate that the cable end 15 and the connector end 25 are descriptors used herein to clarify longitudinal locations and contacting interrelationships between the various elements of the coaxial connector 1. In addition to the identified positions in relation to adjacent elements along the coaxial connector 1 longitudinal axis, each individual element has a cable end 15 side and a connector end 25 side, i.e. the sides of the respective element that are facing the respective cable end 15 and the connector end 25 of the coaxial connector 1.

Figure 4:
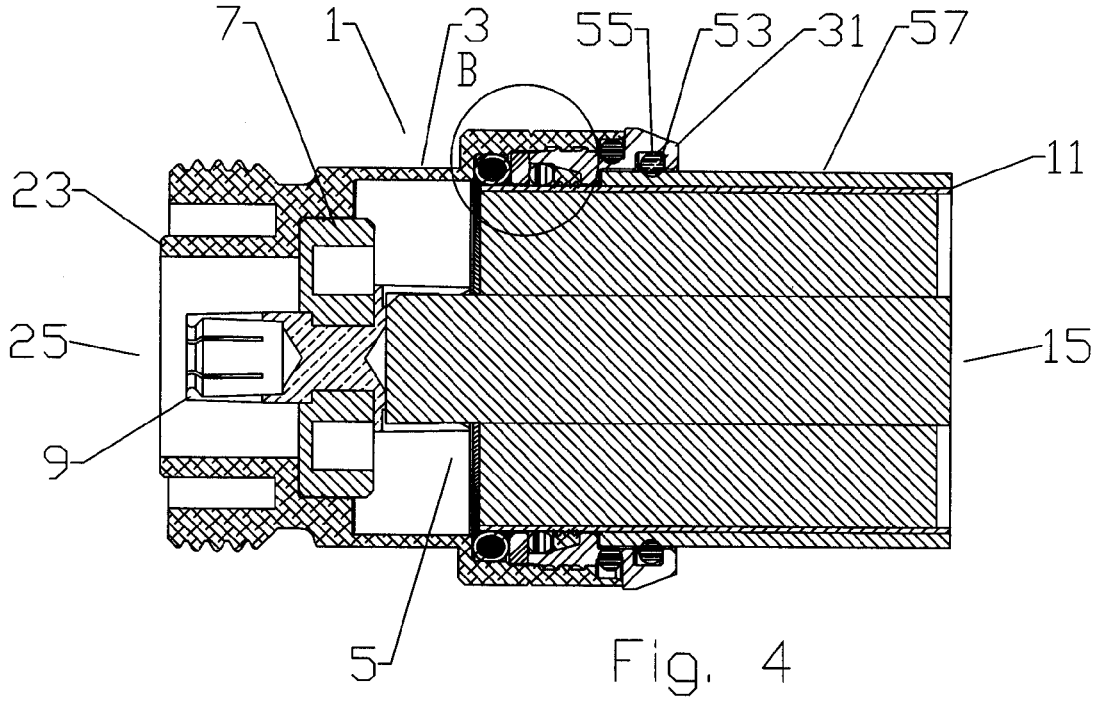
FIG. 4 is a schematic cross-section side view of a first alternative embodiment coaxial connector, with a section of coaxial cable attached.

The grip ring 19 may be retained within the connector body bore 5, for example seated within a grip ring groove 27. For ease of grip ring 19 (and further elements, if present, described herein below) installation and/or enhanced grip ring 19 to outer conductor 11 gripping characteristics, the grip ring groove 27 may be formed wherein the cable end grip ring groove 27 sidewall and/or bottom are surfaces of a clamp nut 31 coupled to the connector body 3, for example as shown in FIGS. 4 and 5.

Figure 5:
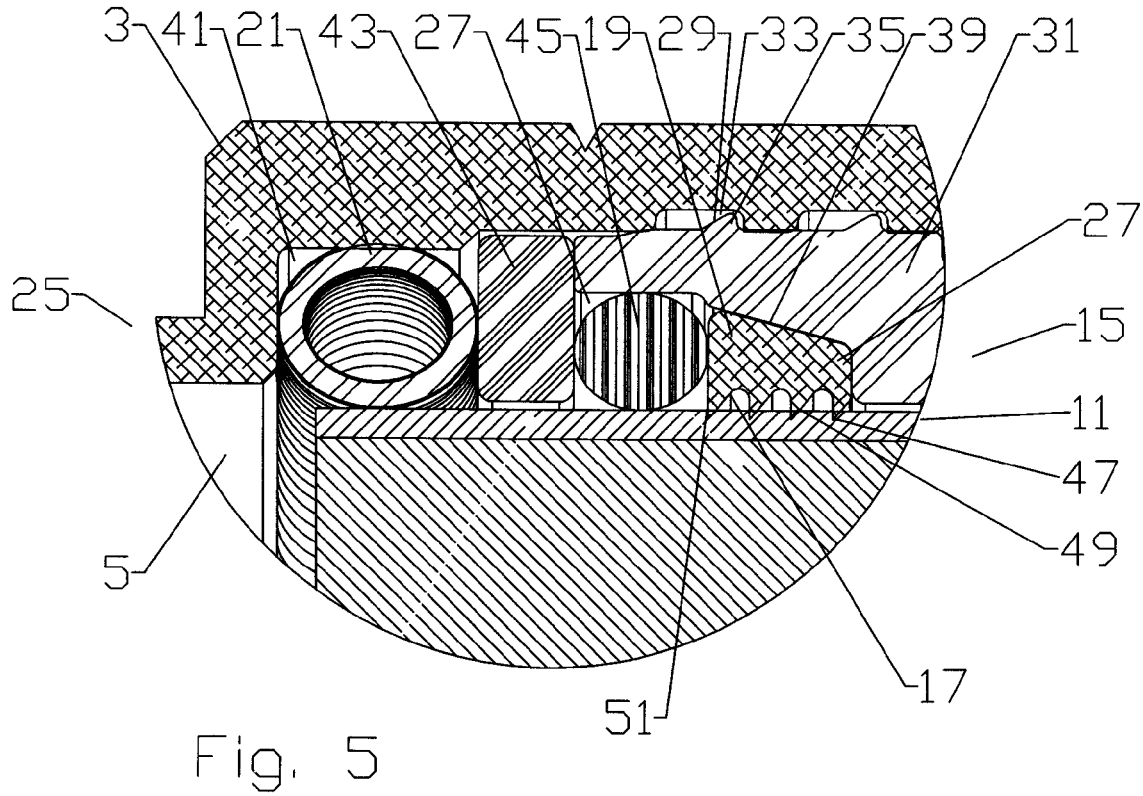
FIG. 5 is a close-up view of area B of FIG. 4.
Figure 6:
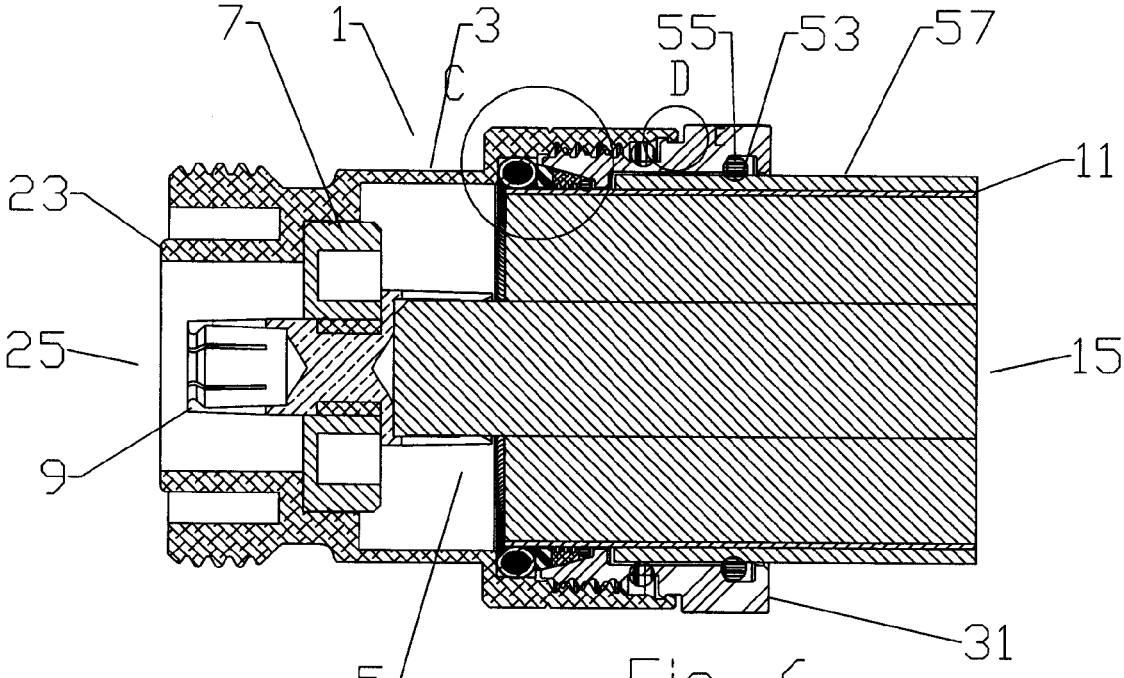
FIG. 6 is a schematic cross-section view of a second alternative embodiment coaxial connector, with a section of coaxial cable attached.

The clamp ring 31, if present, may be coupled to the connector body 3 by a retaining feature 29, such as an interlock between one or more annular snap groove(s) 33 in the sidewall of the connector body bore 5 proximate the cable end 15 and corresponding snap barb(s) 35 provided on an outer diameter of the clamp ring 31, as best shown for example in FIG. 5.

Clamp ring threads 37 between the connector body bore 5 and an outer diameter of the clamp ring 31 may also be provided as an alternative to the retaining feature 29. To enable the coaxial connector 1 to be supplied as a ready for installation assembly, the clamp ring threads 37 may be combined with the snap groove 33 and snap 35 interconnection to provide an assembly that may be supplied with the clamp ring 31 already attached to the connector body 3, preventing disassembly and/or loss of the internal elements, as shown for example in FIGS. 6-9 and 19-20. Where the retaining feature 29 combines the clamp ring threads 37 with the snap groove 33 and snap barb 35, the longitudinal travel of the clamp ring 31 with respect to the connector body 3 via threading along the clamp ring threads 37 is limited by a width within the snap groove 33 across which the snap barb 35 may move before interfering with the snap groove 33 sidewalls.

Figure 20:
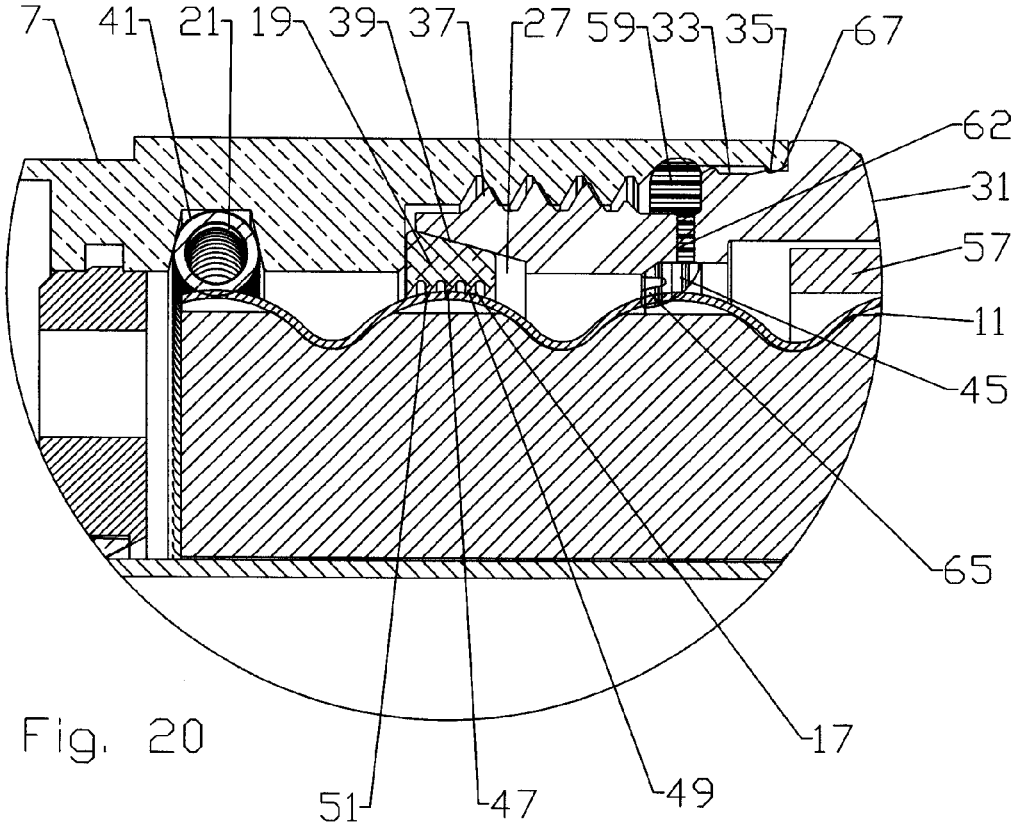
FIG. 20 is a close-up view of area F of FIG. 19.

As best shown in FIG. 20, the retaining feature 29 may also include an interference fit 67 between the connector body 3 and the clamp ring 31, positioned to engage during final threading together of the connector body 3 and the clamp ring 31. The interference fit 67 operative to resist unthreading/loosening of the clamp ring 31 once threaded into the connector body 3.

As best viewed in FIGS. 3, 5, 7, 11 and 20 an annular wedge surface 39 within the grip ring groove 27 has a taper between a maximum diameter at a connector end 25 side and a minimum diameter at a cable end 15 side. An outer diameter of the grip ring 19 contacts the wedge surface 39 and is thereby driven radially inward by passage along the wedge surface 39 towards the cable end 15.

The contact between the outer diameter of the grip ring 19 and the wedge surface 39 may be along a corner of the grip ring 19 that may be rounded to promote smooth travel therealong or alternatively the grip ring 19 may be formed with an extended contact area between the grip ring 19 and the wedge surface 39 by angling the outer diameter profile of the grip ring 19 to be parallel to the taper of the wedge surface 39.

Figure 10:
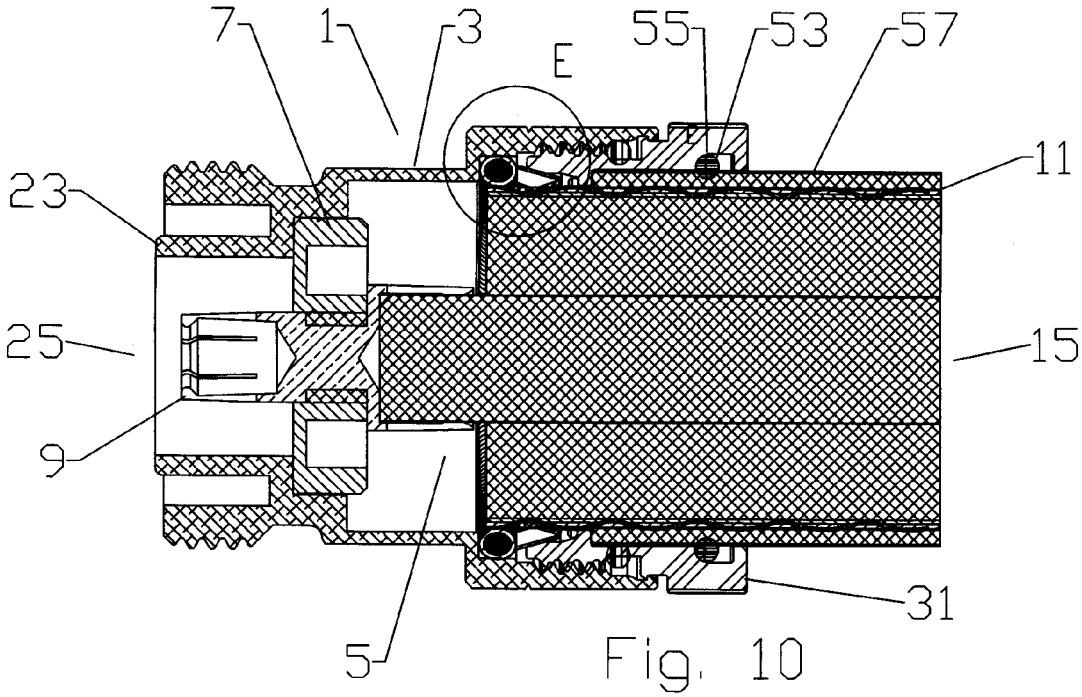
FIG. 10 is a schematic cross-section view of a third alternative embodiment coaxial connector, with a section of coaxial cable attached.
Figure 11:
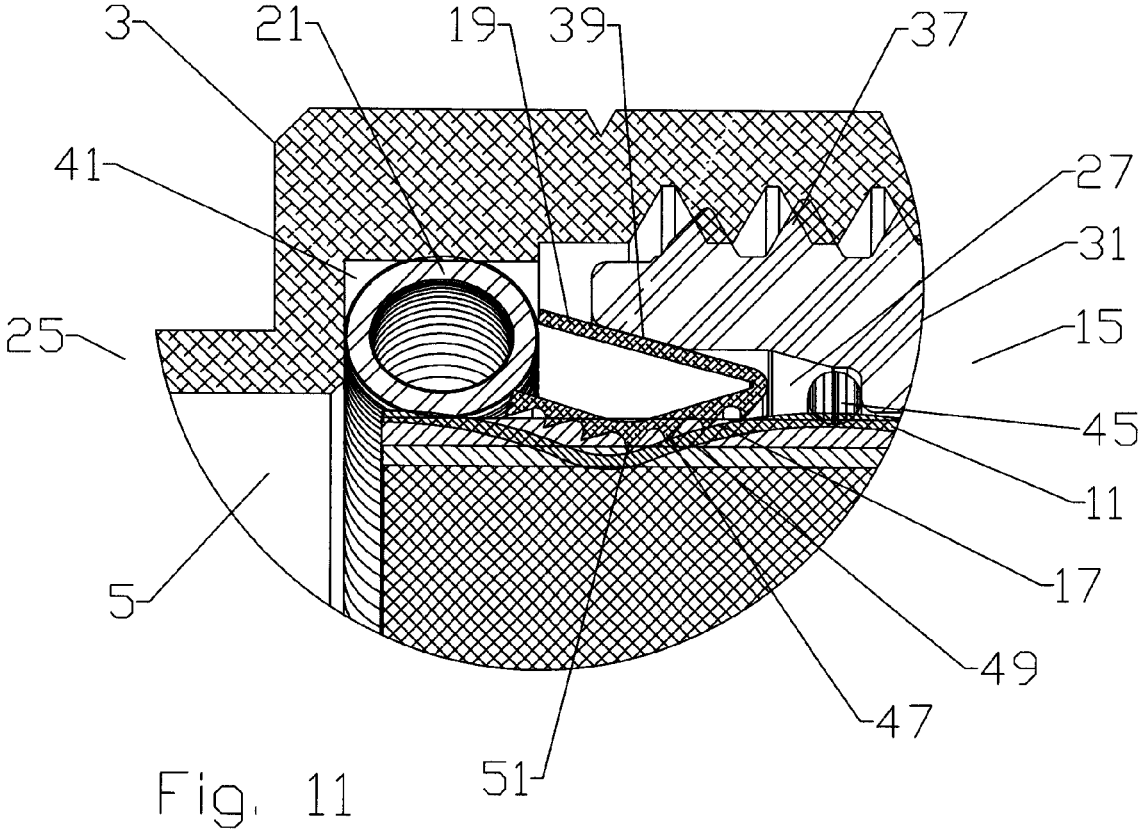
FIG. 11 is a close-up view of area E of FIG. 10.

The spring contact 21 may be any conductive structure with a spring characteristic, such as a helical coil spring, for example as shown in FIGS. 10 and 11, seated in a separate spring groove 41 of the connector body bore 5 sidewall or alternatively seated on a connector end 25 side of the grip ring groove 27. Where the spring contact 21 is in the grip ring groove 27, a spacer 43 may be applied between the spring contact 21 and the grip ring 19 and/or an outer conductor seal 45. The spacer 43 may be seated directly against the connector body 3 or alternatively configured to seat against the wedge surface 39.

Figure 13:
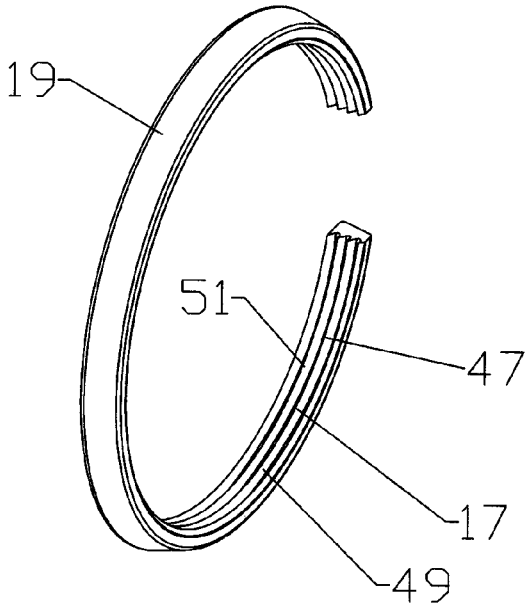
FIG. 13 is a schematic isometric view of a grip ring with a solid cross-section and annular barbs.
Figure 14:
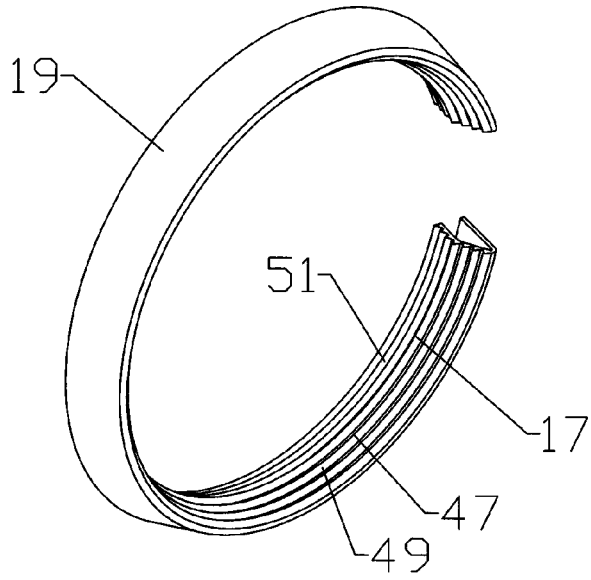
FIG. 14 is a schematic isometric view of a grip ring with a horizontal V cross-section.
Figure 15:
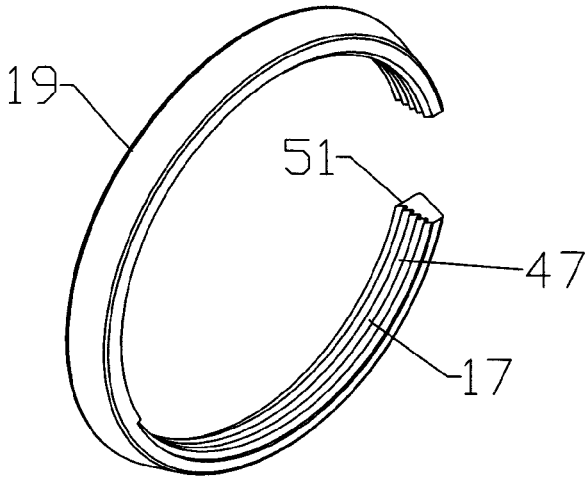
FIG. 15 is a schematic isometric view of a grip ring with a solid cross-section and helical barbs.
Figure 16:
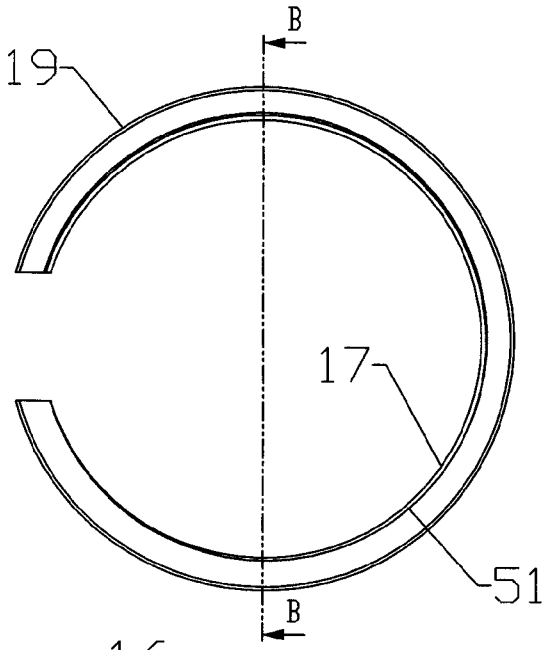
FIG. 16 is a schematic connector end side view of the grip ring of FIG. 15.

The grip ring 19 is preferably formed from a material, such as stainless steel or beryllium copper alloy with a hardness characteristic greater than the material of the outer conductor 11, to enable the grip surface 17 to securely engage and grip the outer diameter of the outer conductor 11. The grip surface 17 of the grip ring 19 has a directional bias, engaging and gripping the outer diameter surface of the outer conductor 11 when in tension towards the cable end 15 while allowing the outer conductor 11 to slide past the grip surface 17 when moved towards the connector end 25. The grip surface 17 may be formed as a plurality of annular (FIGS. 13-14) or helical (FIGS. 15-17) grooves or barb(s) 47 provided with an angled face 49 extending from a groove bottom on the cable end 15 to a groove top on the connector end 25 of each groove and/or barb 47. A stop face 51 opposite the angled face 49 may be a vertical face with respect to the coaxial connector 1 longitudinal axis and/or the stop face 51 may be angled towards the connector end 25 to present a barb point to gouge into and retain the outer conductor 11 when travel is attempted in the direction out of the connector body bore 5 towards the cable end 15.

The grip ring 19 has a range of longitudinal movement within the grip ring groove 27. As the grip ring 19 moves along the wedge surface 39 towards the connector end 25, for example as the leading edge of the outer conductor 11 is inserted into the connector body bore 5 from the cable end 15 and contacts the angled face(s) 49 of the grip surface 17, the grip ring 19 will either spread to allow the outer conductor to pass through, or will also begin to move longitudinally towards the connector end 25, within the grip ring groove 27. Because of the wedge surface 39 taper, as the grip ring 19 moves towards the connector end 25, the depth of the grip ring groove 27 with respect to the grip ring 19 increases. Thereby, the grip ring 19 may be spread radially outward to enable the passage of the outer conductor 11 through the grip ring 19 and towards the connector end 25. Conversely, once spread, the bias of the grip ring 19 inward towards its relaxed state creates a gripping engagement between the grip surface 17 and the outer diameter surface of the outer conductor 11. If tension is applied between the connector body 3 and the coaxial cable 13 to pull the outer conductor 11 towards the cable end 15, the grip ring 19 is driven against the tapered wedge surface 39, progressively decreasing the depth of the grip ring groove 27, thereby driving the grip ring 19 radially inward and further increasing the gripping engagement as grip surface 17 is driven into the outer diameter surface of the outer conductor 11. A cable end 15 grip ring groove 27 sidewall may be dimensioned to be at a position where the grip ring 19 diameter relative to the outer conductor 11 diameter is configured for the grip surface 17 to have securely engaged the outer conductor 11 but which is short of the grip ring 19 radial inward movement from causing the outer conductor 11 to collapse radially inward.

During cable assembly on embodiments with a clamp ring 31 and a retaining feature 29 including the clamp ring threads 37, the limited longitudinal movement obtained by threading the clamp ring 31 into the connector body 3 is operative to drive the wedge surface 39 against the grip ring 19 to move the grip ring 19 radially inward into secure gripping engagement with the outer conductor 11, without requiring the application of tension between the connector body 3 and the coaxial cable 13. Further, in embodiments where the spring contact 21 is also present in the grip ring groove 27, the threading of the clamp ring 31 into the connector body bore 5 may be configured to apply direct and/or via a spacer 43, if present, pressure on the spring contact 21 whereby the spring contact 21 deforms radially inward towards the outer conductor 11, increasing the contact pressure between the spring contact 21 and the outer conductor 11, thereby improving the electrical coupling therebetween.

Figure 7:
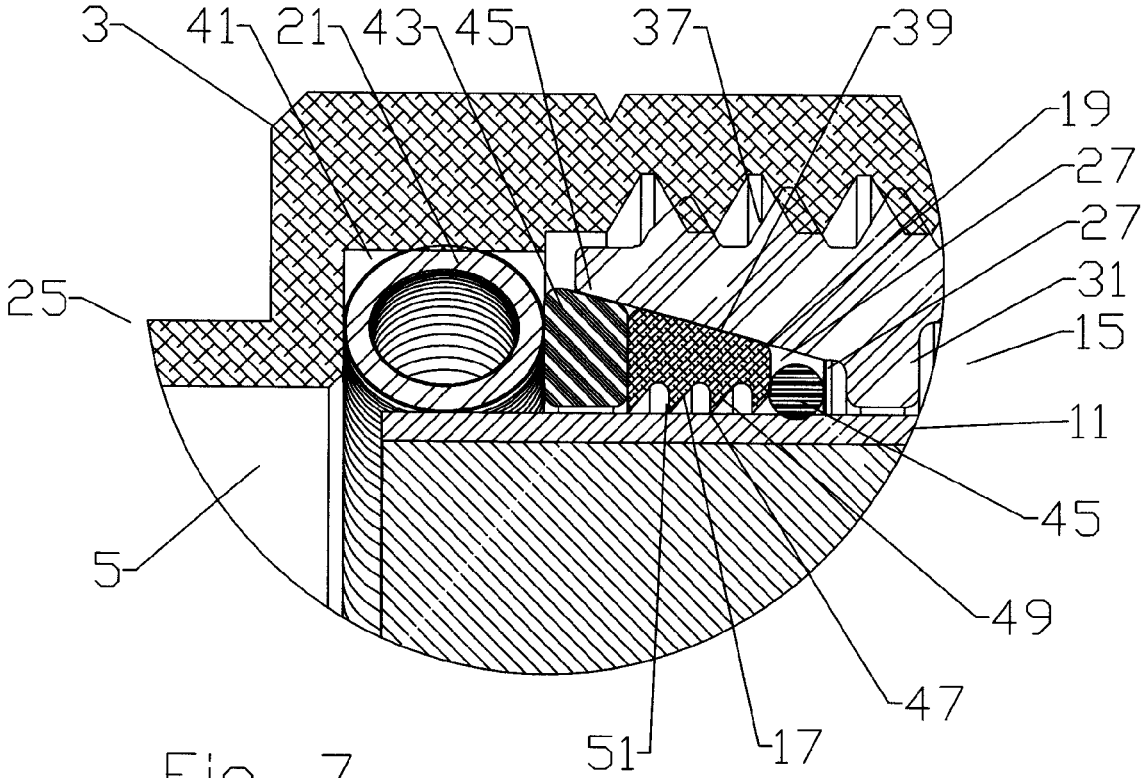
FIG. 7 is a close-up view of area C of FIG. 6.
Figure 8:
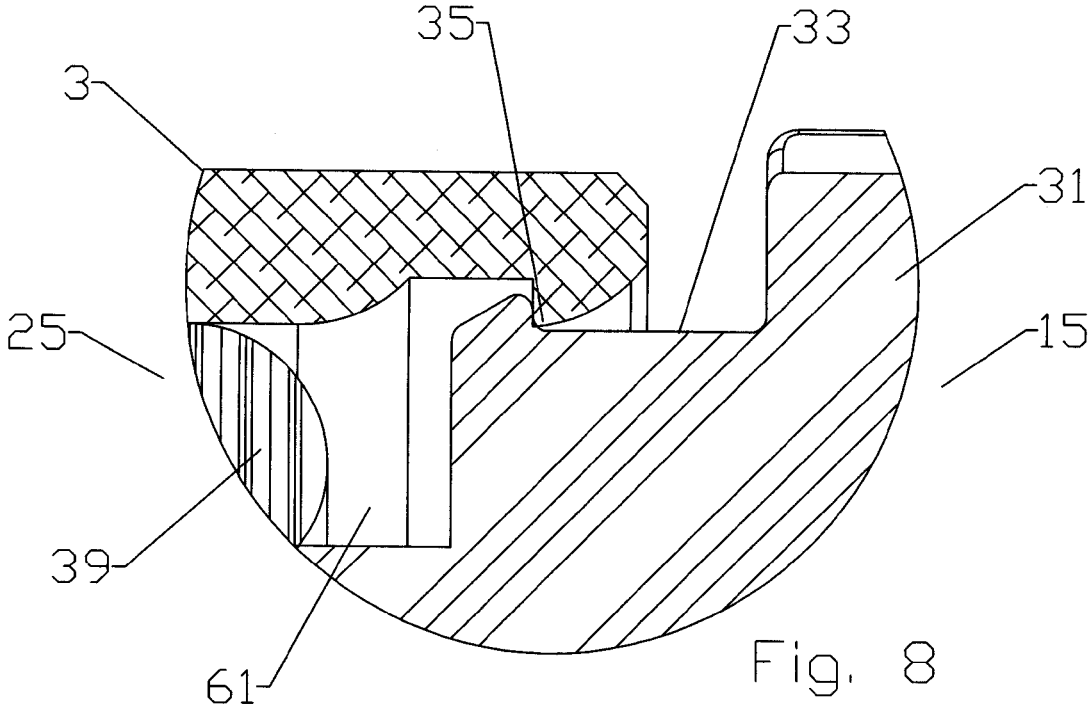
FIG. 8 is a close-up view of area D of FIG. 6.

Elastic characteristics of the outer conductor seal 45, if present, may also impact ease of installation and the final sealing characteristics. For example, where the outer conductor seal 45 is provided on the connector end 25 side of the grip ring 19, for example as shown in FIG. 5, as the passage of the outer conductor 11 biases the grip ring 19 towards the connector end 25 and into the outer conductor seal 45, the outer conductor is compressed. When passage of the outer conductor 11 is complete, the compressed outer conductor seal biases the grip ring 19 towards the cable end 15, into the wedge surface 39 and thus radially inward towards gripping engagement with the outer conductor 11. Where the outer conductor seal 45 is provided on the cable end 15 side of the grip ring 19, for example as shown in FIG. 7, the outer conductor seal 45 is compressed by the grip ring 19 as it is moved towards the cable end 15, thus improving the seal between the outer conductor 11 and the grip ring groove 27.

A jacket seal 53 may be provided in a jacket groove 53 proximate the cable end 15 of the coaxial connector 1. The jacket seal 53 is dimensioned to seal between the connector body bore 5 or clamp ring 31, if present, and the jacket 57. If a clamp ring 31 is present, a further clamp ring seal 59 seated in a clamp ring groove 61 may be provided to seal between the clamp ring 31 and the connector body 3.

Figure 12:
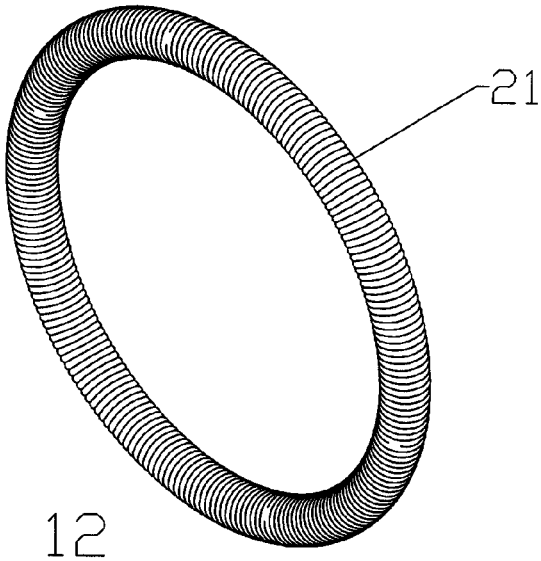
FIG. 12 is a schematic isometric view of a spring contact.
Figure 17:
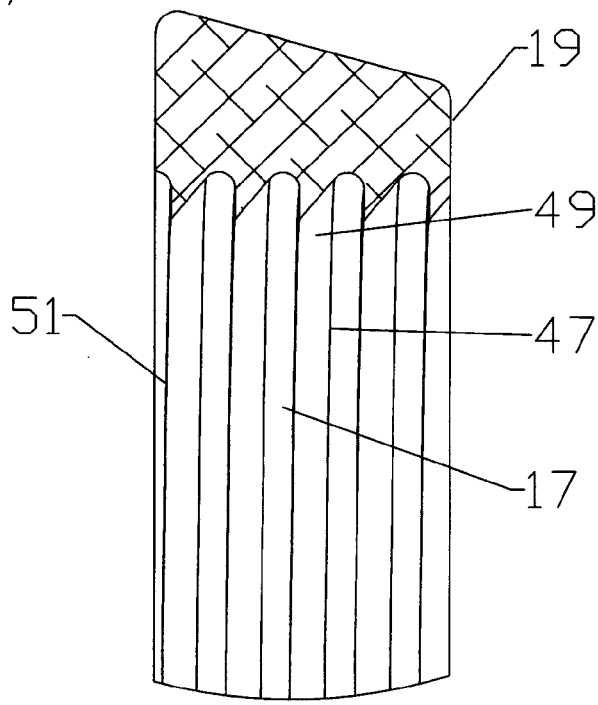
FIG. 17 is a close-up cross section view along line B-B of FIG. 16.

The grip ring 19 may be formed as a c-shaped ring, for example as shown in FIGS. 12 and 17 with a solid cross-section. Alternatively, the grip ring 19 may be formed with a horizontal V and/or U shaped cross-section as shown for example in FIG. 13. In this embodiment, the grip ring 19 has a spring property biasing the grip surface 17 into engagement with the outer diameter surface of the outer conductor 11, rather than a direct mechanical linkage between the radial inward movement of the grip ring 19 according to the longitudinal position of the grip ring 19 with respect to the wedge surface 39.

Figure 9:
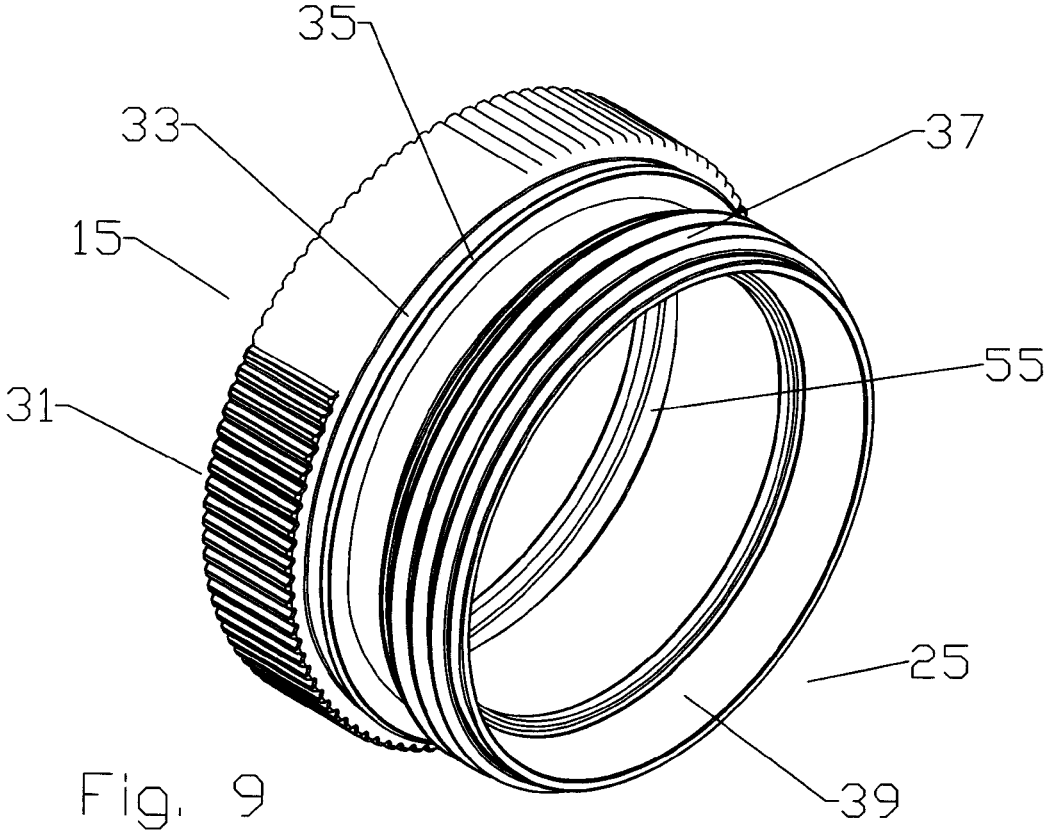
FIG. 9 is a schematic isometric view of the clamp ring of FIG. 6.

The grip surface 17 may be provided with a profile matching the characteristics of a particular solid outer conductor 11, for example a concave curved profile dimensioned to mate with a corrugation trough of an annular corrugated solid outer conductor coaxial cable 13, as shown for example in FIG. 9. Similarly, the curved profile may be a convex configuration, dimensioned to cradle a corrugation peak.

Figure 18:
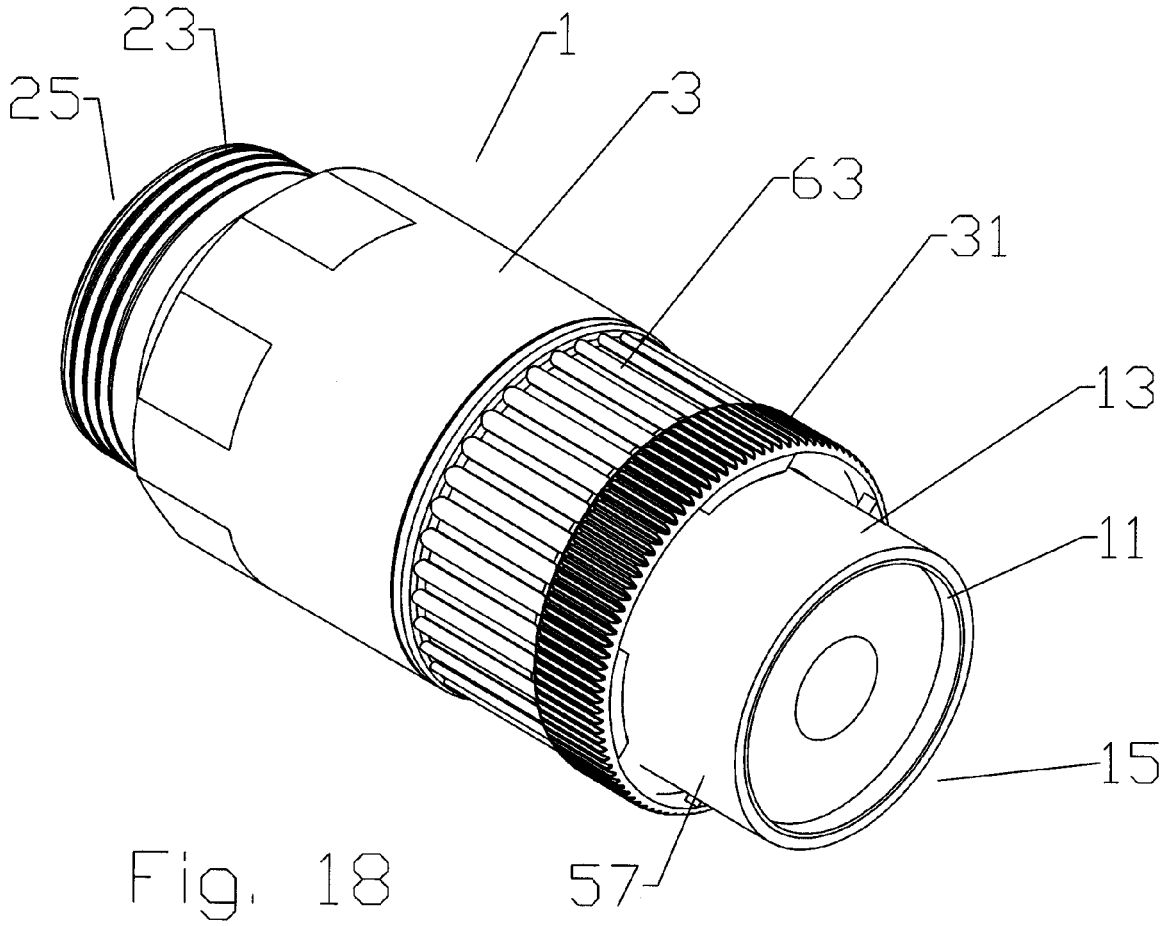
FIG. 18 is a schematic isometric view of a fourth alternative embodiment of a coaxial connector.
Figure 19:
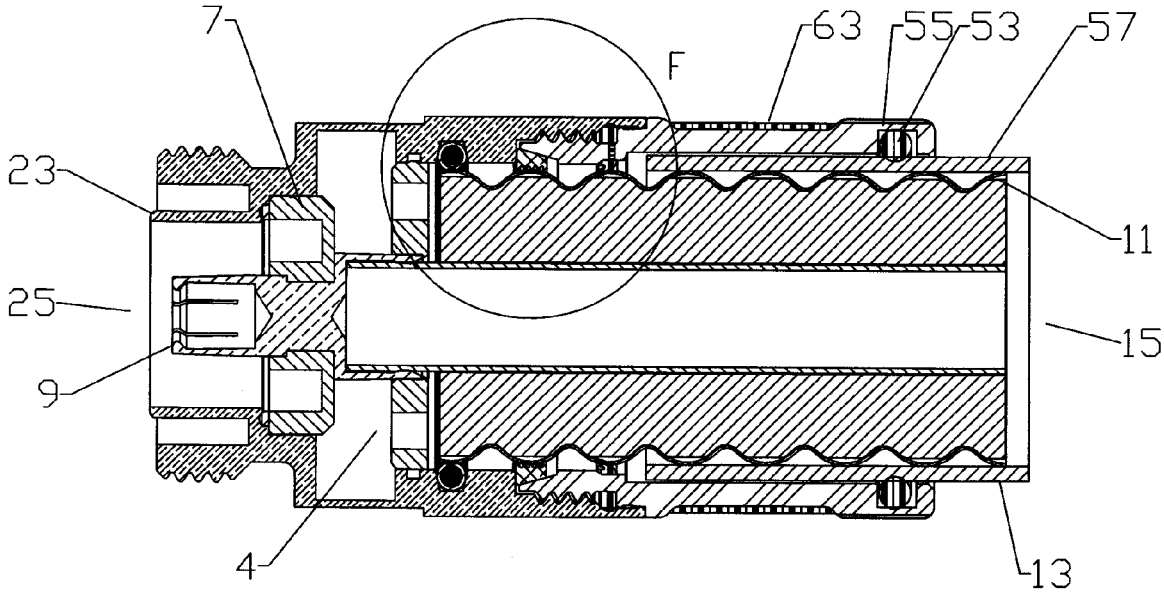
FIG. 19 is a schematic cross-section view of FIG. 18.

One skilled in the art will appreciate the significant manufacturing and installation benefits of the present invention. During manufacturing, a complete coaxial connector 1 assembly ready for installation is prepared with a minimal total number of required elements. If a clamp ring 31 is included in the configuration, the installation of the spring contact 21, spacer 43, grip ring 19 and/or outer conductor seal 45 is simplified by the improved access to the grip ring groove 27, that may then be easily closed by snapping/threading the clamp ring 31 in place after the desired sub elements have been seated in the open end(s) of the connector body bore 5 and/or clamp ring 31. Further, the various environmental seals (outer conductor seal 45, jacket seal 53 and or clamp ring seal 59) may be each overmolded upon the respective groove(s) to provide a single assembly with integral environmental seals. Hole(s) 62 may be formed from the outer diameter to the inner diameter of the clamp ring 31, enabling the outer conductor seal 45 and clamp ring seal 59 to overmolded as a unitary inter-supporting gasket, best shown in FIG. 20. The additional retention of the outer conductor seal 45 provided by overmolding through the hole(s) 62 also enables an outer conductor seal 45 profile with a wiper extension 65. The wiper extension 65 enables the outer conductor seal 45 to more securely seal against both smooth and corrugated outer conductor coaxial cable(s) 13. A further overmolding may be applied in the form of a clamp ring grip 63, for example as shown in FIGS. 18 and 19, on an outer diameter of the clamp ring 31 for improved installer grip during hand threading of the clamp ring 31 into the connector body 3.

To install the coaxial connector 1 upon a coaxial cable 13, the coaxial cable end is stripped back to expose desired lengths of the conductor(s) and the stripped coaxial cable end inserted into the cable end 15 of the connector body bore 5 until bottomed. If present, the clamp ring 31, if including clamp ring threads 37, is then threaded towards the connector body 3 and a test tension between the connector body 3 and the coaxial cable 1 applied to verify secure engagement between the grip ring 19 and the outer conductor 11.

Coaxial connector 1 embodiments with a threaded clamp ring 31 may be uninstalled from the coaxial cable 13 for interconnection inspection and/or reuse by unthreading the clamp ring 31 away from the connector body 3, enabling the grip ring 13 to move outward and away from engagement with the outer conductor 11 as the wedge surface 39 shifts toward the cable end 15 with the clamp ring 31. When the grip ring 13 has disengaged, the coaxial cable 13 may be withdrawn from the connector body bore 5.

The prior manual cable end flaring operations and any required disassembly/reassembly of the various connector elements around the coaxial cable end during installation have been eliminated.

Table of Parts

| | |
|---|---|
| 1 | coaxial connector |
| 3 | connector body |
| 5 | connector body bore |
| 7 | insulator |
| 9 | inner contact |
| 11 | outer conductor |
| 13 | coaxial cable |
| 15 | cable end |
| 17 | grip surface |
| 19 | grip ring |
| 21 | spring contact |
| 23 | connector interface |
| 25 | connector end |
| 27 | grip ring groove |
| 29 | retaining feature |
| 31 | clamp ring |
| 33 | snap groove |
| 35 | snap barb |
| 37 | clamp ring threads |
| 39 | wedge surface |
| 41 | spring groove |
| 43 | spacer |
| 45 | outer conductor seal |
| 47 | barb |
| 49 | angled face |
| 51 | stop face |
| 53 | jacket seal |
| 55 | jacket groove |
| 57 | jacket |

-continued

| Table of Parts | |
|---|---|
| 59 | clamp ring seal |
| 61 | clamp ring groove |
| 62 | hole |
| 63 | clamp ring grip |
| 65 | wiper extension |
| 67 | interference fit |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector with a connector end and a cable end for coupling with a coaxial cable with a solid outer conductor, the connector comprising:

a connector body provided with a connector body bore;

a grip ring retained within the connector body bore; an outer diameter of the grip ring abutting an annular wedge surface; the wedge surface provided with a taper between a maximum diameter proximate the connector end and a minimum diameter proximate the cable end;

an inner diameter of the grip ring provided with a grip surface;

a spring contact retained within the connector body bore;

the grip surface and an inner diameter of the spring contact dimensioned to receive the outer conductor from the cable end therethrough and couple with an outer diameter of the outer conductor absent any additional external forces.

2. The coaxial connector of claim 1, wherein the grip surface comprises a plurality of barbs.

3. The coaxial connector of claim 1, wherein an angle of an outer diameter surface of the grip ring is parallel to the taper of the wedge surface.

4. The connector of claim 1, wherein the spring contact is a helical coil spring.

5. The connector of claim 1, wherein the grip surface has a curve corresponding to a corrugation trough of the solid outer conductor.

6. The coaxial connector of claim 1, wherein the wedge surface is formed in a sidewall of the connector body bore.

7. The coaxial connector of claim 6, further including an outer conductor seal abutting the connector end of the grip ring; the outer conductor seal dimensioned to seal between the connector body and the outer diameter of the outer conductor.

8. The connector of claim 1, wherein the grip ring has a generally v-shaped cross-section.

9. The connector of claim 8, wherein the grip surface has a curve corresponding to a corrugation trough of the solid outer conductor.

10. The connector of claim 1, wherein the grip ring abuts cable end of the spring contact.

11. The connector of claim 10, further including an outer conductor seal abutting the cable end of the grip ring; the outer conductor seal dimensioned to seal between the connector body and the outer diameter of the outer conductor.

12. The coaxial connector of claim 1, further including a clamp ring coupled to the cable end of the connector body;

the wedge surface formed in an inner diameter of the clamp ring, proximate the connector end of the clamp ring.

13. The connector of claim 12, further including an annular spacer between the spring contact and the grip ring.

14. The connector of claim 13, wherein an outer diameter of the annular spacer abuts the wedge surface.

15. The coaxial connector of claim 12, wherein the clamp ring is coupled to the cable end of the connector body by a retaining feature.

16. The connector of claim 15, wherein the retaining feature is a thread between the connector body sidewall and an outer diameter of the clamp ring; the thread operable to drive the wedge surface towards the spring contact.

17. The connector of claim 15, wherein the retaining feature is an annular snap groove provided in the sidewall of the connector body bore and a corresponding snap barb on an outer diameter of the clamp ring.

18. The connector of claim 17, further including a thread between the connector body sidewall and an outer diameter of the clamp ring; the thread operable to drive the wedge surface towards the spring contact.

19. A coaxial connector with a connector end and a cable end for coupling with a coaxial cable with a solid outer conductor, the connector comprising:

a connector body provided with a connector body bore;

a grip ring retained within the connector body bore; an outer diameter of the grip ring abutting an annular wedge surface; the wedge surface provided with a taper between a maximum diameter proximate the connector end and a minimum diameter proximate the cable end;

an inner diameter of the grip ring provided with a grip surface;

an outer diameter surface of the grip ring parallel to the taper of the wedge surface;

a clamp ring coupled to the cable end of the connector body by a retaining feature;

the wedge surface formed in an inner diameter of the clamp ring, proximate the connector end of the clamp ring;

a spring contact retained within the connector body bore;

the grip surface and an inner diameter of the spring contact dimensioned to receive the outer conductor from the cable end therethrough and couple with an outer diameter of the outer conductor absent any additional external forces.

20. The connector of claim 19, further including a clamp ring seal dimensioned to seal between the clamp ring and the connector body; and an outer conductor seal dimensioned to seal between the clamp ring and the outer conductor;

the clamp ring seal and the outer conductor seal formed as a unitary overmolded body via at least one hole formed in the clamp ring.

21. The connector of claim 19, wherein the grip surface is provided with a curved profile corresponding to a corrugation trough of the solid outer conductor.

* * * * *